US010337350B2

(12) United States Patent
Thomas

(10) Patent No.: US 10,337,350 B2
(45) Date of Patent: Jul. 2, 2019

(54) GAS TURBINE ENGINE

(71) Applicant: ROLLS-ROYCE PLC, London (GB)

(72) Inventor: Keith Jeremy Paul Thomas, Derby (GB)

(73) Assignee: ROLLS-ROYCE PLC, London (GB)

( * ) Notice: Subject to any disclaimer, the term of this patent is extended or adjusted under 35 U.S.C. 154(b) by 1017 days.

(21) Appl. No.: 14/630,771

(22) Filed: Feb. 25, 2015

(65) Prior Publication Data

US 2015/0267556 A1 Sep. 24, 2015

(30) Foreign Application Priority Data

Mar. 21, 2014 (GB) ..... 1405049.6

(51) Int. Cl.
*F01D 25/24* (2006.01)
*F01D 21/04* (2006.01)

(52) U.S. Cl.
CPC ..... *F01D 21/045* (2013.01); *F05D 2220/36* (2013.01); *F05D 2250/232* (2013.01); *F05D 2250/282* (2013.01); *F05D 2250/283* (2013.01); *F05D 2260/96* (2013.01); *F05D 2300/501* (2013.01)

(58) Field of Classification Search
CPC ..... F01D 21/045
See application file for complete search history.

(56) References Cited

U.S. PATENT DOCUMENTS 4,452,565 A * 6/1984 Monhardt ..... F01D 21/045 138/110
6,059,523 A * 5/2000 Modafferi ..... F01D 21/045 415/173.1
6,913,436 B2 * 7/2005 McMillan ..... F01D 21/045 415/173.4
2004/0141837 A1 7/2004 McMillan et al.
2010/0189552 A1 * 7/2010 Evans ..... F01D 21/045 415/182.1
2011/0016882 A1 * 1/2011 Woelke ..... F02C 7/00 60/796
2013/0160458 A1 * 6/2013 Willmot ..... F02C 7/12 60/783

FOREIGN PATENT DOCUMENTS

EP 2 623 727 A2 8/2013
GB 2 066 354 A 7/1981

OTHER PUBLICATIONS

Oct. 31, 2014 Search Report issued in British Application No. 1405049.6.

* cited by examiner

*Primary Examiner* — Kayla McCaffrey
(74) *Attorney, Agent, or Firm* — Oliff PLC

(57) ABSTRACT

A fan containment system for fitment around an array of radially extending fan blades mounted on a hub in an axial gas turbine engine. The fan containment system comprises a fan case having an annular casing element for encircling an array of fan blades. An annular fan track liner is positioned substantially coaxial to the annular casing element, and one or more pockets are provided in a radially outer side of the fan track liner. One or more dampers for damping vibration of the fan track liner are positioned in each of the one or more pockets and are arranged so as to contact the annular casing element.

16 Claims, 4 Drawing Sheets

GAS TURBINE ENGINE

FIELD OF INVENTION

The invention relates to a fan containment system, a casing assembly, a fan and/or a gas turbine engine.

BACKGROUND

Turbofan gas turbine engines (which may be referred to simply as 'turbofans') are typically employed to power aircraft. Turbofans are particularly useful on commercial aircraft where fuel consumption is a primary concern. Typically a turbofan gas turbine engine will comprise an axial fan driven by an engine core. The engine core is generally made up of one or more turbines which drive respective compressors via coaxial shafts. The fan is usually driven directly off an additional lower pressure turbine in the engine core.

The fan comprises an array of radially extending fan blades mounted on a rotor and will usually provide, in current high bypass gas turbine engines, around seventy-five percent of the overall thrust generated by the gas turbine engine. The remaining portion of air from the fan is ingested by the engine core and is further compressed, combusted, accelerated and exhausted through a nozzle. The engine core exhaust mixes with the remaining portion of relatively high-volume, low-velocity air bypassing the engine core through a bypass duct.

To satisfy regulatory requirements, such engines are required to demonstrate that if part or all of a fan blade were to become detached from the remainder of the fan, that the detached parts are suitably captured within the engine containment system.

The fan is radially surrounded by a fan casing. It is known to provide the fan casing with a fan track liner and a containment system designed to contain any released blades or associated debris. Often, the fan track liner can form part of the fan containment system.

The fan track liner typically includes an annular layer of abradable material which surrounds the fan blades. During operation of the engine, the fan blades rotate freely within the fan track liner. At maximum speed the blades may cut a path into this abradable layer creating a seal against the fan casing and minimising air leakage around the blade tips during cruise. Further incursions can occur during gusts or take off rotations over time.

A conventional fan containment system or arrangement 100 is illustrated in FIG. 1 and surrounds a fan comprising an array of radially extending fan blades 40. Each fan blade 40 has a leading edge 44, a trailing edge 45 and fan blade tip 42. The fan containment arrangement 100 comprises a fan case 150. The fan case 150 has a generally frustoconical or cylindrical annular casing element 152 and a hook 154. The hook 154 is positioned axially forward of an array of radially extending fan blades 40. A fan track liner 156 is mechanically fixed or directly bonded to the fan case 150. The fan track liner 156 is provided as a structural intermediate to bridge a deliberate gap provided between the fan case 150 and the fan blade tip 42.

The fan track liner 156 has, in circumferential layers, an attrition liner 158 (also referred to as an abradable liner or an abradable layer), an intermediate layer which in this example is a honeycomb layer 160, and a septum 162. The septum layer 162 acts as a bonding, separation, and load spreading layer between the attrition liner 158 and the honeycomb layer 160. The honeycomb layer 160 may be an aluminium honeycomb. The tips 42 of the fan blades 40 are intended to pass as close as possible to the attrition liner 158 when rotating. The attrition liner 158 is therefore designed to be abraded away by the fan blade tips 42 during abnormal operational movements of the fan blade 40 and to just touch during the extreme of normal operation to ensure the gap between the rotating fan blade tips 42 and the fan track liner 156 is as small as possible without wearing a trench in the attrition liner 158. During normal operations of the gas turbine engine, ordinary and expected movements of the fan blade 40 rotational envelope cause abrasion of the attrition liner 158. This allows the best possible seal between the fan blades 40 and the fan track liner 156 and so improves the effectiveness of the fan in driving air through the engine.

The purpose of the hook 154 is to ensure that, in the event that a fan blade 40 detaches from the rotor of the fan 12, the fan blade 40 will not be ejected through the front, or intake, of the gas turbine engine. During such a fan-blade-off event, the fan blade 40 is held by the hook 154 and a trailing blade (not shown) forces the held released blade rearwards where the released blade is contained. Thus the fan blade 40 is unable to cause damage to structures outside of the gas turbine engine casings.

As can be seen from FIG. 1, for the hook 154 to function effectively, a released fan blade 40 must penetrate the attrition liner 158 in order for its forward trajectory to intercept with the hook. If the attrition liner 158 is too hard then the released fan blade 40 may not sufficiently crush the fan track liner 156.

However, the fan track liner 156 must also be stiff enough to withstand the rigours of normal operation without sustaining damage. This means the fan track liner 156 must be strong enough to withstand ice and other foreign object impacts without exhibiting damage for example. Thus there is a design conflict, where on one hand the fan track liner 156 must be hard enough to remain undamaged during normal operation, for example when subjected to ice impacts, and on the other hand allow the tip 42 of the fan blade 40 to penetrate the attrition liner 158. It is a problem of balance in making the fan track liner 156 sufficiently hard enough to sustain foreign object impact, whilst at the same time, not be so hard as to alter the preferred hook-interception trajectory of a fan blade 40 released from the rotor. Ice that impacts the fan casing rearwards of the blade position is resisted by a reinforced rearward portion 164 of the fan track liner.

An alternative fan containment system is indicated generally at 200 in FIG. 2. The fan containment system 200 includes a fan track liner 256 that is connected to the fan casing 250 at both an axially forward position and an axially rearward position. At the axially forward position, the fan track liner is connected to the casing at hook 254 via a fastener 266 that is configured to fail at a predetermined load. In the event of a fan blade detaching from the remainder of the fan, the fan blade impacts the fan track liner 256, the fastener 266 fails and the fan track liner pivots about a rearward point on the fan track liner. Such an arrangement is often referred to as a trap door arrangement. The trap door arrangement has been found to help balance the requirements for stiffness of the fan track liner with the requirements for resistance of operational impacts (e.g. ice impacts) ensuring a detached blade is held within the engine.

Often the fan track liner is formed from a plurality of arcuate fan track liner panels. Forming the fan track liner from a plurality of panels means that if a region of the fan track liner is damaged, only the affected panels need to be replaced. To ease removal of the fan track liner panels for such repair work, it is preferable for the fan track liner panels to be releasably connected to the fan casing, e.g. using bolts, instead of being adhered or bonded to the fan casing. However, when the fan track liner panels are releasably connected to the casing the fan track liner panels can vibrate during normal use, e.g. due to the pressure profile formed by passing blades during the operation of the fan. It is desirable to limit any such vibration to a minimal level. Excessive vibration can result in increased noise, increased blade to fan track liner clearance, and loss in engine performance. In very extreme cases, the vibration could lead to failure of the fan track liner panels or damaging interactions with the fan blades.

Several proposals for energy absorption during a fan blade off scenario are known, but these do not address the problem of damping vibration of the fan track liner during normal operation of a gas turbine engine.

SUMMARY OF INVENTION

In a first aspect the present invention provides a fan containment system for fitment around an array of radially extending fan blades mounted on a hub in an axial gas turbine engine. The fan containment system comprises a fan case having an annular casing element for encircling an array of fan blades. An annular fan track liner is positioned substantially coaxial to the annular casing element. One or more pockets are provided in a radially outer side of the fan track liner.

One or more resilient members for snubbing and/or damping vibration of the fan track liner may be positioned in each of the one or more pockets and may be arranged so as to contact the annular casing element.

The resilient members damp and/or snub vibration of the fan track liner during operation of the engine. Providing the resilient members in pockets helps to ensure that there is contact between the resilient members and the annular casing element even through there are differing manufacturing tolerances of the fan track liner and the casing element. This increased certainty of contact means that the force applied to the casing by the resilient members can be better controlled. Further, the pockets contribute to retention of the resilient members during operation of a gas turbine engine.

The one or more resilient members may be considered to be dampers and/or a snubbers. For example, one or more dampers for damping and/or snubbing vibration of the fan track liner may be positioned in each of the one or more pockets and may be arranged so as to contact the annular casing element. Additionally or alternatively, one or more snubbers for snubbing and/or damping vibration of the fan track liner may be positioned in each of the one or more pockets and are arranged so as to contact the annular casing element.

The resilient member may be made from a viscoelastic material. As will be understood by the person skilled in the art, a viscoelastic material exhibits both viscous and elastic characteristics when undergoing deformation. Example viscoelastic materials include natural rubber, synthetic rubber or elastomers.

A second aspect of the invention provides a fan containment system for fitment around an array of radially extending fan blades mounted on a hub in an axial gas turbine engine. The fan containment system comprises a fan case having an annular casing element for encircling an array of fan blades. An annular fan track liner is positioned substantially coaxial to the annular casing element and has one or more pockets formed therein. One or more viscoelastic dampers for damping vibration of the fan track liner are positioned in each of the one or more pockets.

The following are optional features of the first and/or the second aspect. As will be understood by the person skilled in the art the optional features may be used in combination with one or more of the other disclosed optional features. Features applicable to the resilient members are equally applicable to the viscoelastic dampers.

The pockets may extend only partially through the fan track liner. In this way, the pockets avoid interference with a gas washed surface of the fan track liner.

A gap may be provided between the fan track liner and the annular casing element.

The dampers may be dimensioned relative to the pockets and the gap between the fan track liner and the annular casing element, such that the damper contacts the casing element even when the respective pocket is located in a region having a maximum gap (compared to the rest of the gap) between the fan track liner and the casing element.

The resilient member may be shaped for optimal load transfer to the casing element. For example, the area of the resilient member in contact with the casing may be smaller than the area of the resilient member in contact with the fan track liner (e.g. the area of the base of the resilient member may be larger than the area of the resilient member in contact with the fan track liner).

The resilient member may be conical or frusto-conical in shape.

An end of the resilient member adjacent the casing element may be castellated. For example, the resilient member may be cylindrical with a castellated end.

Provision of a conical member and/or a castellated member contributes to providing a member that always applies a force to the annular casing element even if the damper is located in a region having a relatively large gap between the fan track liner and the annular casing element (compared to the rest of the fan track liner).

The resilient members may be positioned at locations corresponding to anti-node points of expected operational modes of vibration. Expected modes of vibration can be calculated using known testing and/or modelling techniques. Positioning the members at anti-node points can help to further reduce vibration of the fan track liner.

The resilient members may be constructed so as to compress into the pockets so that there is substantially no protrusion of the resilient members from the fan track liner at a pre-determined load. Such an arrangement means that under large loading conditions, e.g. bird or ice impact, the resilient members can compress (e.g. compress fully) into the pockets so as to allow any high loading impacts to be reacted by the fan track liner.

The fan track liner may comprise a separation layer. The fan track liner may comprise an intermediate layer positioned on a radially inner side of the separation layer. The fan track liner may comprise an abradable layer positioned on a radially inner side of the separation layer and/or the intermediate layer. A septum layer may be provided between the intermediate layer and the abradable layer.

The fan track liner may comprise a further intermediate layer connected to a radially outer side of the separation layer. In exemplary embodiments, the separation layer may be tray.

The further intermediate layer may comprise the one or more pockets. For example, the pockets may extend through the entire or near entire thickness of the intermediate layer, e.g. the pockets may terminate at the separation layer.

Provision of the further intermediate layer and provision of the pockets in said further intermediate layer is a preferred method of ensuring the dampers do not impede on the operation of the fan track liner in the event that a fan blade (or part of a fan blade) is released from a hub or in the event that the fan track liner is impacted by ice or a bird.

The further intermediate layer may comprise a honeycomb structure (e.g. an aluminium (or alloy thereof) honeycomb structure).

The fan track liner may comprise a plurality of arcuate fan track liner panels positioned coaxially so as to define the annular fan track liner.

The fan case may comprise a hook projecting in a generally radially inward direction from the annular casing element and positioned axially forward of an array of fan blades when the fan containment system is fitted around said fan blades.

A third aspect of the invention provides a gas turbine engine comprising the fan containment system according to the first or second aspect.

A fourth aspect of the invention provides a gas turbine engine comprising:

a casing;

a component positioned radially outward of the casing;

a bracket connecting the component to the casing;

an intermediate layer (e.g. honeycomb layer) positioned between the component and the casing, and one or more dampers;

wherein one or more pockets are formed in the intermediate layer and one of the one or more dampers is positioned in each of the one or more pockets.

The dampers may perform the function of damping and/or snubbing.

The component may be a raft assembly. In the present application, a raft assembly is referred to as a substantially rigid composite panel in which electrical conductors are embedded, the electrical conductors may form part of an electrical harness for a gas turbine engine.

DESCRIPTION OF DRAWINGS

The invention will now be described, by way of example only, with reference to the accompanying drawings in which.

DETAILED DESCRIPTION

Figure 1:
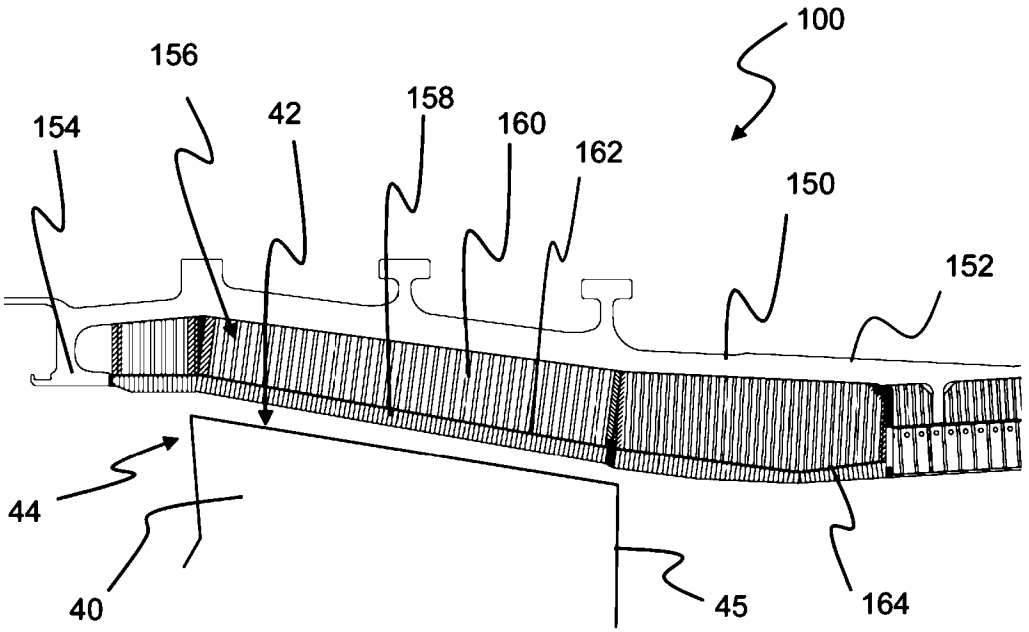
Fig. 1 PRIOR ART
FIG. 1 illustrates a partial view of a cross-section through a typical fan case arrangement of a gas turbine engine of the prior art.
Figure 2:
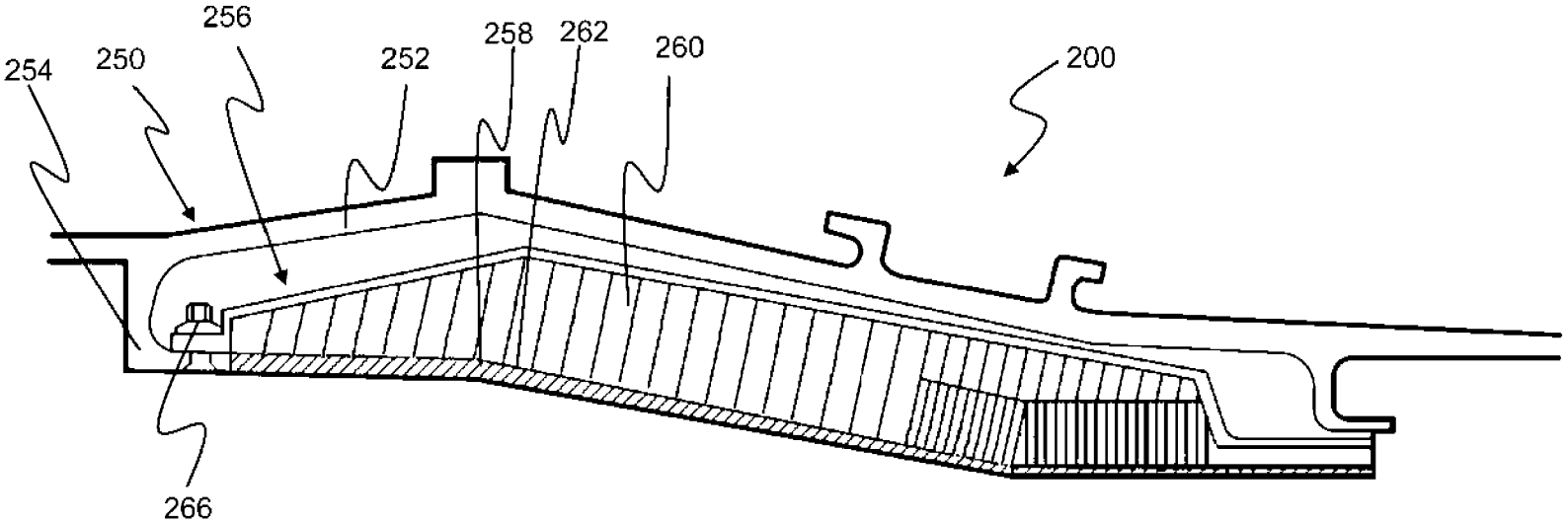
Fig. 2 PRIOR ART
FIG. 2 illustrates a partial view of a cross-section through an alternative fan case arrangement of a gas turbine engine of the prior art.
Figure 3:
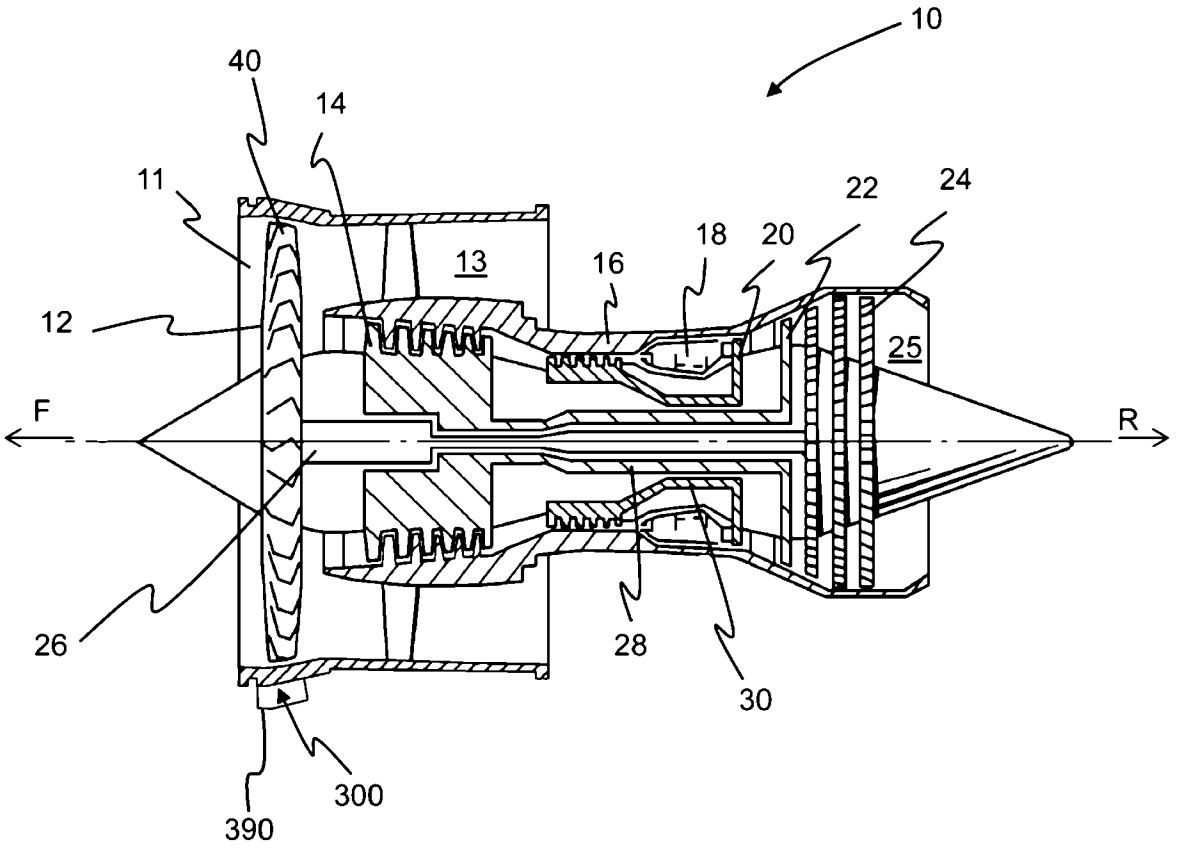
FIG. 3 illustrates a cross-section through the rotational axis of a high-bypass gas turbine engine.

With reference to FIG. 3 a bypass gas turbine engine is indicated at 10. The engine 10 comprises, in axial flow series, an air intake duct 11, fan 12, a bypass duct 13, an intermediate pressure compressor 14, a high pressure compressor 16, a combustor 18, a high pressure turbine 20, an intermediate pressure turbine 22, a low pressure turbine 24 and an exhaust nozzle 25. The fan 12, compressors 14, 16 and turbines 18, 20, 22 all rotate about the major axis of the gas turbine engine 10 and so define the axial direction of the gas turbine engine.

Air is drawn through the air intake duct 11 by the fan 12 where it is accelerated. A significant portion of the airflow is discharged through the bypass duct 13 generating a corresponding portion of the engine thrust. The remainder is drawn through the intermediate pressure compressor 14 into what is termed the core of the engine 10 where the air is compressed. A further stage of compression takes place in the high pressure compressor 16 before the air is mixed with fuel and burned in the combustor 18. The resulting hot working fluid is discharged through the high pressure turbine 20, the intermediate pressure turbine 22 and the low pressure turbine 24 in series where work is extracted from the working fluid. The work extracted drives the intake fan 12, the intermediate pressure compressor 14 and the high pressure compressor 16 via shafts 26, 28, 30. The working fluid, which has reduced in pressure and temperature, is then expelled through the exhaust nozzle 25 generating the remainder of the engine thrust.

The intake fan 12 comprises an array of radially extending fan blades 40 that are mounted to the shaft 26. The shaft 26 may be considered a hub at the position where the fan blades 40 are mounted. FIG. 3 shows that the fan 12 is surrounded by a fan containment system 300 that also forms one wall or a part of the bypass duct 13.

In the present application a forward direction (indicated by arrow F in FIG. 3) and a rearward direction (indicated by arrow R in FIG. 3) are defined in terms of axial airflow through the engine 10.

Figure 4:
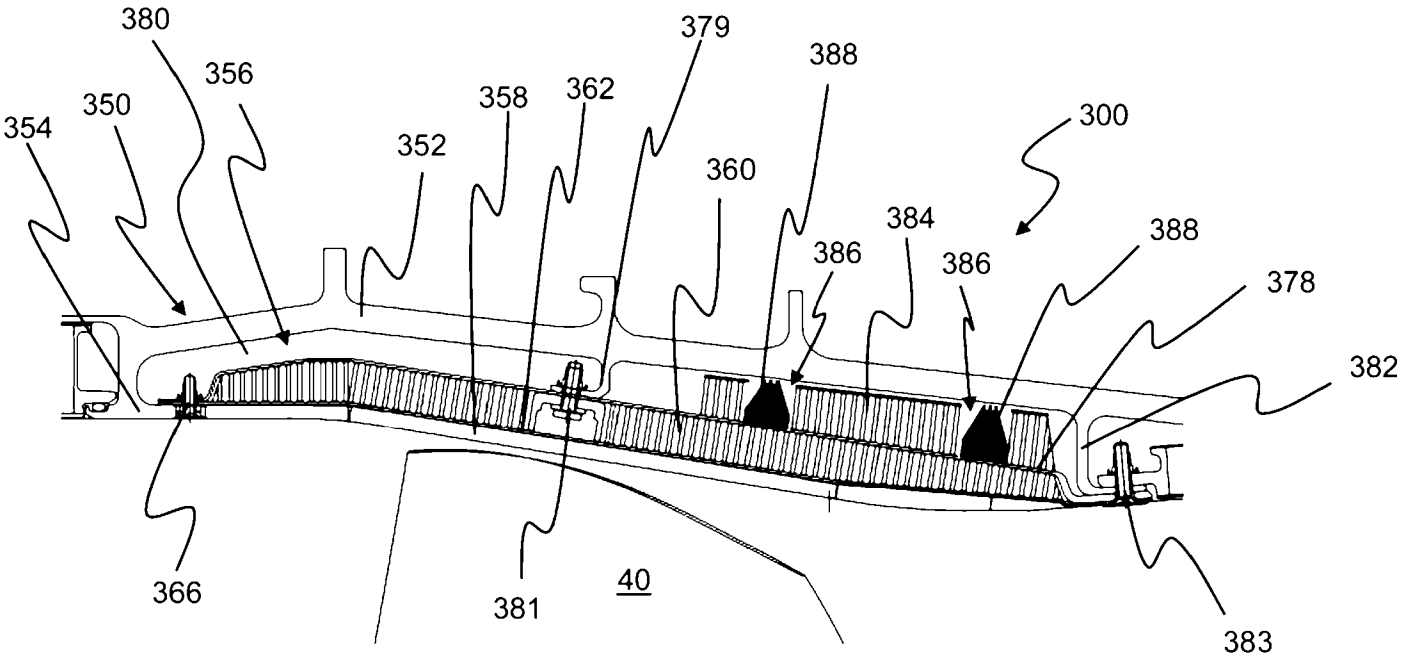
FIG. 4 illustrates a partial cross-section through a fan blade containment system.

Referring now to FIG. 4, the fan containment system 300 is shown in more detail. The fan containment system 300 comprises a fan case 350. The fan case 350 includes an annular casing element 352 that, in use, encircles the fan blades 40 of the gas turbine engine (indicated at 10 in FIG. 3). The fan case 350 further includes a hook 354 that projects from the annular casing element in a generally radially inward direction. The hook 354 is positioned, in use, axially forward of the fan blades and the hook is arranged so as to extend axially inwardly, such that if a fan blade (or part of a fan blade) detaches from the rotor the hook 354 prevents the fan blade from exiting the engine through the air intake duct (indicated at 11 in FIG. 3).

In the present embodiment, the hook 354 is substantially L-shaped and has a radial component extending radially inwards from the annular casing element 352 and an axial component extending axially rearward towards the fan blades 40 from the radial component.

A fan track liner 356 is connected to the fan case 350 at the hook 354 via a connector that is configured to permit movement of the fan track liner relative to the hook when a pre-determined force is applied to the fan track liner. In the present embodiment, the connector includes a plurality of circumferentially spaced fasteners 366 designed to shear/fracture at a predetermined load such that movement of the fan track liner radially outwards towards the annular casing element 352 is permitted when a load exerted on the fan track liner exceeds a predetermined level (in alternative embodiments an alternative fastening mechanism may be used e.g. a crushable collar or a sprung fastener).

A forward portion of the fan track liner 356 is spaced radially inward from the annular casing element 352 so that a voidal region 380 is formed between the forward portion of the fan track liner 356 and the casing element 352.

In the present embodiment, the fan track liner 356 is formed from a plurality of arcuate panels positioned substantially coaxial so as to define the annular fan track liner.

A standoff 379 protrudes radially inwardly from the casing element 352. The standoff is positioned axially between a forward end of the fan track liner 356 and a rearward end of the fan track liner. Each fan track liner panel is connected to the standoff via a fastener 381, e.g. a bolt. The fastener 381 is covered by material of the fan track liner so that the fan track liner panels have a substantially smooth gas washed surface. The standoff may be a series of L-shaped protrusions or a continuous L-shaped protrusion extending circumferentially around a radially inner surface of the casing element.

A rearward end of the fan track liner 356 is connected to a support member 382. The support member 382 protrudes radially inwards from the annular casing element 352. In the present embodiment, the support member 382 is formed of a series of circumferentially spaced L-shaped protrusions, but in alternative embodiments the support member may extend fully around the annular casing element (i.e. with no interruptions/spacing). In the present embodiment, the fan track liner 356 is connected to the support using a plurality of fasteners 383. The connection and manufacturing tolerances of the annular casing to the support member is such that any step between the fan track liner and adjacent panel (e.g. acoustic panel) will be out-of-flow (i.e. stepped radially outward) so as to improve aerodynamics.

In the event of a fan blade (or part of a fan blade) being released from the remainder of the fan, the fan blade will impact the fan track liner and the fastener of the impacted fan track liner panel or fan track liner panels will fail. The impacted fan track liner panel will then pivot, at least initially, about the standoff 379 to make room for the fan blade to impact the hook 354 for containment.

The construction of the fan track liner 356 will now be described in more detail. The fan track liner 356 includes a tray 378 to which an intermediate layer 360 is connected (e.g. bonded) to a radially inner surface of the tray. An attrition layer (or abradable layer) 358 is positioned, in use, proximal to the fan blades 40. A septum layer 362 provides an interface between the attrition layer and the intermediate layer 360, forming part of the bond between the two. The septum layer 362 also separates the attrition layer and the intermediate layer and distributes any applied load between the attrition layer and the intermediate layer. The tray 378 is connected to the hook 354 via the fastener 366 so as to connect the fan track liner 356 to the fan case 350.

A further intermediate layer (which may also be referred to as a backing layer or a filler layer) 384 is bonded to a radially outer surface of the tray 378. The further intermediate layer 384 is provided at an axially rearward end of the fan track liner. More specifically, the further intermediate layer is spaced rearwardly from the standoff and extends to a rearward end of the fan track liner. The further intermediate layer 384 extends radially outwardly from the tray towards the annular casing element, with a gap provided between the further intermediate layer and the annular casing element. However, as will be appreciated by the person skilled in the art, due to manufacturing tolerances, the radial length of the gap may vary as a significant proportion of the intended (small) nominal radial length.

In the present embodiment the intermediate layer and the further intermediate layer are formed from an aluminium honeycomb structure. However, in alternative embodiments the honeycomb structure may be made from any other suitable material, e.g. an alternative metallic material, or the intermediate layer may be formed by a material such as suitable foam.

The septum layer, attrition layer and tray may be made from any suitable material, but by way of example only, the septum layer may be formed from a carbon fibre or glass reinforced polymer; the attrition layer may be formed of an epoxy resin that is curable at room temperature; and the tray may be formed of a carbon fibre or glass reinforced polymer.

Pockets 386 are formed in the fan track liner panel. In the present embodiment the pockets extend through the depth of the further intermediate layer 384 and terminate at the tray 378. The pockets may be considered counter bores provided in the intermediate layer. In the present embodiment the pockets or counter bores have a circular cross section, but the pockets may be provided with any suitable cross section. The pockets are spaced at regular or irregular intervals circumferentially around the fan track liner 356. In the present embodiment two rows of pockets are provided, one axially rearward of the other. However, it will be appreciated that the pockets may not be provided in rows and may instead be staggered axially in location around the fan track liner. In alternative embodiments an alternative pocket arrangement may be provided, for example, the pockets 386 may be positioned so as to correspond to anti-node points of vibration modes known to occur during the operation of the gas turbine engine.

A resilient member that acts as both a damper and a snubber is positioned in each pocket 386. In the present embodiment, each component is a conical damper 388.

The damper extends out of the pocket and contacts the annular casing element 352. The conical shape of the damper means that the damper has a firm base on the fan track liner 356 and a smaller contact with the annular casing element 352. As will be appreciated by the person skilled in the art, the annular casing element will usually be made to higher tolerance levels than the fan track liner, which means that the gap between the fan track liner and the casing element will vary. The small contact area between the conical damper and the annular casing element means that the damper can be sized to project radially outward from the outer intermediate layer of the liner 384 and are designed to deform on contact with the annular casing element 352 when the fasteners 381 and 383 are secured. Thus the resilient members provide firm contact between the fan track liner 356 and the annular casing 352 between the fastening points 381 and 383 in a way that overcomes the variation of the gap between the fan track liner 356 and the annular casing 352 due to manufacturing tolerances.

The damper is made from a viscoelastic material. In this way the damper displays both elastic and viscous properties so as to damp vibration of the fan track liner during operation of the engine.

The viscoelastic material and/or the shape of the damper is also selected such that under major loads, for example ice or bird impact, the dampers can compress into the pockets so as to allow the load to be reacted by the full area of the further intermediate layer that will contact the casing element in such a high loading event. It will be appreciated by the person skilled in the art that the construction of the fan track liner will be selected so as to allow such movement without sustaining permanent damage.

Advantageously, the described damper arrangement reduces vibration of the fan track liner during operation of the gas turbine engine. In the present embodiment, this advantageously means that the fan track liner can be formed from a plurality of panels without suffering from unacceptable vibration levels.

As well as damping the vibration, the conical damper 388 also performs a snubbing function. That is, the conical damper 388 resists movement in one direction (i.e. towards the annular casing element 352) and so the natural response of the fan track liner is snubbed. For example, a "bowstring"

vibration mode of the fan track liner between its bolted fixing points to the casing is limited or prevented because half of the vibration cycle in which the panel would otherwise deflect towards the casing is snubbed by the presence of the damper cones.

Positioning of the dampers within the pockets means that the dampers are fully enclosed by the pockets and the casing element, so the risk of potential failure by non-retention of the dampers is mitigated.

It will be appreciated by one skilled in the art that, where technical features have been described in association with one embodiment, this does not preclude the combination or replacement with features from other embodiments where this is appropriate. Furthermore, equivalent modifications and variations will be apparent to those skilled in the art from this disclosure. Accordingly, the exemplary embodiments of the invention set forth above are considered to be illustrative and not limiting.

For example, the damper has been described as a conical damper, but the damper may take any suitable shape. For example, the damper may be cylindrical in shape and/or may have one end that is castellated.

In the described embodiment the damper is made from a viscoelastic material, but in alternative embodiments any other damper displaying both elastic and viscous properties may be used.

The fan containment system described has a trap door arrangement, but the dampers may be used with other types of fan containment systems. For example, a gas turbine engine having composite fan blades may not have a hook or a trap door arrangement because the majority of a released blade is likely to break up on impact with the fan track liner, but provision of dampers in a similar way as described can still be beneficial.

The position of the further intermediate layer has been described as axially rearward of the standoff, but the further intermediate layer may be positioned at any point along the tray of the fan track liner, provided that it does not restrict operation of the fan containment system, e.g. in a trap door arrangement a gap between the fan track liner and the annular casing element should be provided near to the hook to give the fan track liner room to move towards the annular casing element in a fan blade off event.

In the present embodiment, pockets are provided in the further intermediate layer and terminate at the tray, but in alternative embodiments the pockets may extend further into the fan track liner than the tray or the tray may include depressions to accommodate a portion of the dampers. In further alternative embodiments, no intermediate layer may be provided and instead the pockets may be provided in one or more of the other layers of the fan track liner, and/or the tray may include depressions to accommodate the dampers.

In the present embodiment, a tray is provided between the intermediate layer and the further intermediate layer, but in alternative embodiments the tray may be replaced by any suitable separation or septum layer. In further alternative embodiments, any suitable number of septum layers may be provided. The pockets may extend to any one of the septum layers. In further alternative embodiments the pockets may be alternative depths extending to different septum layers and containing different sized conical dampers for tuning to different modes of vibration.

An alternative application of the honeycomb and damper arrangement described above is for use in damping a raft bracket 390, or some other type of bracket connected to a casing (e.g. fan casing) of the gas turbine engine. For example, the raft 390 may be connected to a radially outer surface of an annular casing of the gas turbine engine via two or more brackets. An aluminium honeycomb layer may be provided between the casing and the raft 390. Holes or pockets may be formed in the honeycomb layer and conical dampers positioned therewithin. In this way, the conical dampers will damp vibration of the raft 390 relative to the casing. The raft 390 may also be referred to as a substantially rigid composite panel in which electrical conductors are embedded, the electrical conductors may form part of an electrical harness for a gas turbine engine.

The invention claimed is:

1. A fan containment system for fitment around an array of radially extending fan blades mounted on a hub in an axial gas turbine engine, the fan containment system comprising:

a fan case having an annular casing element that encircles the array of fan blades;

an annular fan track liner positioned substantially coaxial to the annular casing element and extending around the array of fan blades in the fan case, the annular fan track liner including: (i) a tray connecting the fan track liner to the fan case, (ii) a first intermediate layer fixed to a radially inner surface of the tray and positioned radially inward of the annular casing element, and (iii) a second intermediate layer fixed to a radially outer surface of the tray and positioned radially outward of the first intermediate layer and abutting the first intermediate layer via the tray, the second intermediate layer including one or more pockets recessed into the second intermediate layer; and one or more resilient members configured to snub or damp vibration of the fan track liner, one of the one or more resilient members being positioned in each of the one or more pockets, the one or more resilient members being arranged to contact a radially inner side of the annular casing element.

2. The fan containment system according to claim 1, wherein the one or more resilient members are made from a viscoelastic material.

3. The fan containment system according to claim 1, wherein an area of the one or more resilient members in contact with the annular casing element is smaller than an area of the one or more resilient members in contact with the fan track liner.

4. The fan containment system according to claim 3, wherein the one or more resilient members are conical or frusto-conical in shape.

5. The fan containment system according to claim 3, wherein an end of the one or more resilient members adjacent to the annular casing element is castellated.

6. The fan containment system according to claim 1, wherein the one or more resilient members are positioned at locations corresponding to anti-node points of expected operational modes of vibration.

7. The fan containment system according to claim 1, wherein the one or more resilient members are constructed so as to compress into the one or more pockets so that there is substantially no protrusion of the one or more resilient members from the fan track liner at a pre-determined load.

8. The fan containment system according to claim 1, wherein the fan track liner includes the first intermediate layer provided on a radially inner side of the tray, and an abradable layer provided on a radially inner side of the first intermediate layer.

9. The fan containment system according to claim 8, wherein the fan track liner includes the second intermediate layer connected to a radially outer side of the separation layer.

10. The fan containment system according to claim 9, wherein the second intermediate layer includes the one or more pockets.

11. The fan containment system according to claim 9, wherein the second intermediate layer includes a honeycomb structure.

12. The fan containment system according to claim 1, wherein the fan track liner includes a plurality of arcuate fan track liner panels positioned coaxially so as to define the fan track liner.

13. A fan containment system for fitment around an array of radially extending fan blades mounted on a hub in an axial gas turbine engine, the fan containment system comprising:

a fan case having an annular casing element that encircles the array of fan blades;

an annular fan track liner positioned substantially coaxial to the annular casing element and extending around the array of fan blades in the fan case, the annular fan track liner including: (i) a tray connecting the fan track liner to the fan case, (ii) a first intermediate layer fixed to a radially inner surface of the tray and positioned radially inward of the annular casing element, and (iii) a second intermediate layer fixed to a radially outer surface of the tray and positioned radially outward of the first intermediate layer and abutting the first intermediate layer via the tray, the second intermediate layer including one or more pockets recessed into the second intermediate layer; and one or more viscoelastic dampers configured to damp vibration of the fan track liner, one of the one or more dampers being positioned in each of the one or more pockets.

14. A gas turbine engine comprising the fan containment system according to claim 1.

15. A gas turbine engine comprising:

a casing;

a component positioned radially outward of the casing;

a bracket connecting the component to the casing;

an intermediate layer positioned between the component and the casing, the intermediate layer being positioned radially outward of the casing, the intermediate layer including one or more pockets recessed into the intermediate layer; and one or more dampers formed of a viscoelastic material, one of the one or more dampers being positioned in each of the one or more pockets.

16. The gas turbine engine according to claim 15, wherein the component is a raft assembly.

* * * * *